United States Patent [19]

Blyth et al.

[11] Patent Number: 4,900,005

[45] Date of Patent: Feb. 13, 1990

[54] SHEET FEED APPARATUS

[75] Inventors: Richard C. Blyth, Lymington; Jeffrey J. Masters, St. Albans; Ian Hirst, Royston; Leonard V. Gates, Widford, all of England

[73] Assignee: Xerox Corporation, Stamford, Conn.

[21] Appl. No.: 209,825

[22] Filed: Jun. 22, 1988

[30] Foreign Application Priority Data

Jun. 26, 1987 [GB] United Kingdom ..... 8715009
Jun. 26, 1987 [GB] United Kingdom ..... 8715010

[51] Int. Cl.[4] ..... B65H 1/08

[52] U.S. Cl. ..... 271/127; 271/126; 271/117; 271/157; 271/162; 271/164

[58] Field of Search ..... 271/117, 126, 127, 157, 271/162, 164

[56] References Cited

U.S. PATENT DOCUMENTS 3,588,106 6/1971 Csaba et al. ..... 271/61
3,698,804 10/1972 Cranskens et al. ..... 355/3
3,799,538 3/1974 Suzuki ..... 271/162
3,827,687 8/1974 Kono ..... 271/117
4,083,553 4/1978 Beck et al. ..... 271/4
4,106,763 8/1978 Tani et al. ..... 271/9
4,285,510 8/1981 Kanno et al. ..... 271/127
4,487,406 12/1984 Kabashima ..... 271/127

FOREIGN PATENT DOCUMENTS 0012530 1/1987 Japan ..... 271/157
2061231 5/1981 United Kingdom ..... 271/127

*Primary Examiner*—Joseph J. Rolla
*Assistant Examiner*—Boris Milef

[57] ABSTRACT

A sheet feed apparatus for a copying machine comprises a cassette for holding a stack of sheets to be fed. The cassette is in the form of an open-topped housing containing a base plate for supporting the stack of sheets. A handle is provided which is coupled to a mechanism for raising, preferably tilting, at least part of the base plate right out of the cassette housing to facilitate loading sheets within the tight tolerances of the cassette housing. A rear registration guide and a pair of relatively small side guides are provided which do not impede stack loading but allow the stack to be positioned sufficiently accurately that when the handle—and hence the base plate—is lowered the stack is able to enter the cassette housing without further adjustment.

16 Claims, 4 Drawing Sheets

SHEET FEED APPARATUS

Figure 1:
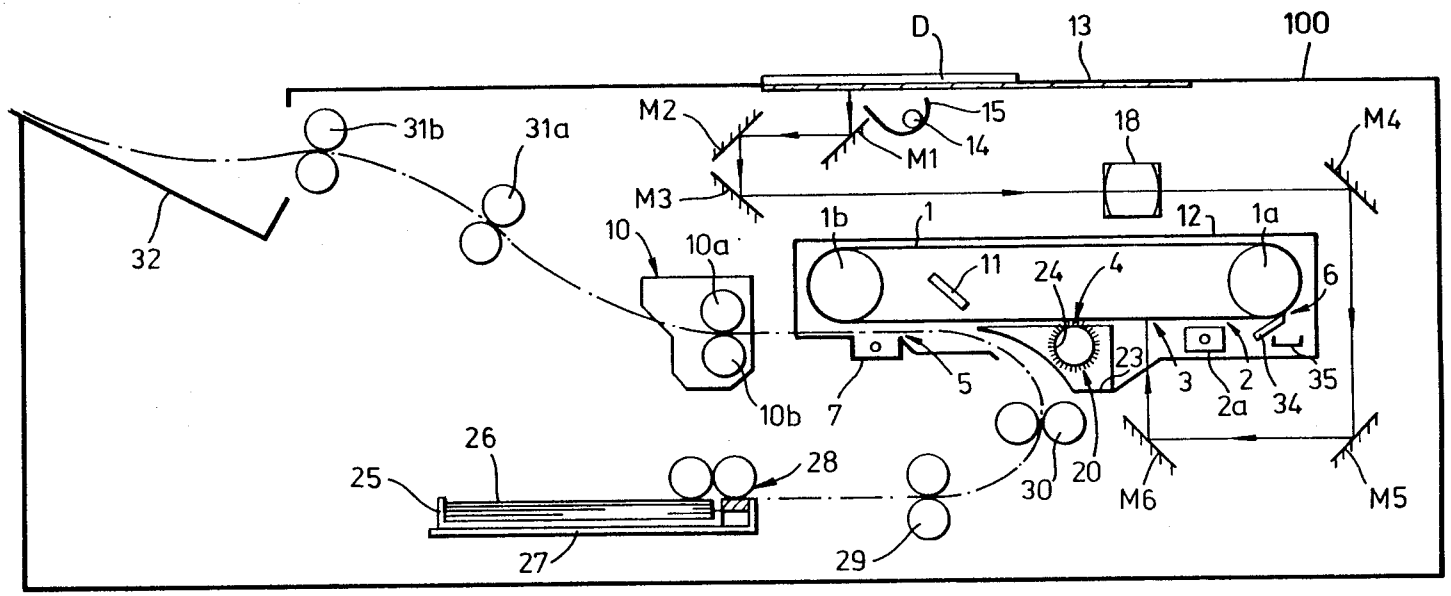

This invention relates to a sheet feed apparatus for a copying machine, comprising a cassette for holding a stack of sheets to be fed.

In the copier art, sheet-feeding cassettes are well known and generally comprise an open-topped housing containing a base plate for supporting the stack of sheets to be fed.

For example U.S. Pat. No. 4,106,763 discloses such a cassette wherein the rear edge of the base plate is tiltably connected to the base of the cassette housing and a mechanically operated actuator arm is insertable through a hole in the bottom of the cassette housing to tilt the base plate upwardly within the cassette housing to bring a stack of sheets present thereon into operative contact with a top-sheet feeding device which extends into the cassette housing. U.S. Pat. No. 4,487,406 discloses a cassette-type sheet feeding apparatus in which a lever can be rotated to retract a pressing member when the cassette is to be withdrawn from the copier. Upon insertion of the cassette, the lever and pressing member are released from their respective retracted positions to press papers in the cassette against a feed roller.

Alternatively, it is known in prior art cassettes to urge the base plate towards the top-sheet feed means by compression springs provided in the cassette beneath the base plate.

Other known sheet feeding devices devoid of a cassette having a moving base plate include U.S. Pat. No. 3,588,106 which relates to a sheet feeding apparatus for a photocopying machine in which a storage compartment for copy sheets is covered by a lid. Feed rollers and corner separators are mechanically connected to the lid so as to move upwardly from a feeding position upon opening the lid. In this loading position, a stack of copy paper sheets can be replenished on a feed tray in the compartment; U.S. Pat. No. 3,799,538 that discloses a copy sheet cassette mounting device for a copying apparatus in which a copy sheet feed tray is moved between a sheet feeding position and a cassette mounting position conjointly with the closing and opening of a cover for the feed tray. The cassette is separate from the feed tray and can be mounted or dismounted thereon when the cover is open and the tray is in the cassette mounting position; U.S. Pat. No. 3,827,687 discloses a device supporting a paper cassette in an electrophotographic copier. One side of the copier includes a casing wall having a lid for access therein. Preferably, the lid has a pair of brackets, each being pivoted at the lower end of the casing wall. A cassette supporter member also pivots on the casing wall so as to move between an operational position and a cassette receiving position; and U.S. Pat. No. 4,083,553 which discloses a copy sheet handling apparatus for a copier including a supply tray slidably secure to a framework and moveable between a feeding position and a loading position. Sheet aligning means are also disclosed in the patent which include a stop, actuable by a lever arm. Loading a copy sheet on the supply tray is accomplished by lifting a bar 154 and rotating a shaft 98 to move the supply tray to a loading position. Disclosed in U.S. Pat. No. 3,698,804 is a photocopying machine which includes a stack holder 14 to hold a stack of sheets of copying paper. At one end of the stack is a group of rollers with a withdrawing roller 15 and an arrangement of transfer rollers. A top cover 1 is adapted to be opened in the area above the stack holder, withdrawing roller, and transfer roller arrangement.

It is a characteristic of cassette design that the internal dimensions of the cassette housing closely match the dimensions of the sheets contained therein. These tight tolerances can make it difficult for an operator to load a stack of sheets in the cassette and there is a risk of damaging individual sheets. Often an operator may find that he/she has to divide a large stack into smaller sub-stacks and load these one at a time to ensure that all the sheets are properly stacked in the cassette.

According to the present invention there is provided a sheet feed apparatus for a copying machine comprising a cassette for holding a stack of sheets to be fed, wherein the cassette comprises an open-topped housing containing a base plate for supporting the stack of sheets, characterised by a manually operable actuator coupled to means for raising at least part of the base plate out of the cassette housing to facilitate loading sheets in the cassette.

The manually operable actuator, which preferably is in the form of a handle, can be moved by the operator to lift at least part of the base plate right out of the cassette housing so that a complete stack of sheets can easily be loaded thereon, and then the actuator may be operated to return the base plate to its working position whereby the stack of sheets supported thereon is lowered into the cassette housing.

To ensure registration of the stack of sheets the base plate may have an upstanding registration guide provided at its rear edge, as well as an upstanding guide at each opposite side edge adjacent the rear edge. However, in order that these guides do not inhibit sheet loading the side guides are preferably substantially shorter than the side edges of the base plate. In a preferred embodiment the base plate is pivotally mounted within the cassette housing adjacent the rear registration guide. Thus when the actuator is operated the base plate is tilted about the pivot axis so that only the front portion of the base plate protrudes above the level of the cassette housing. This inclined arrangement further aids loading as the stack of sheets tends to slide against the rear registration guide under the force of gravity. In one particular arrangement, the raising mechanism is adapted to hold the base plate locked in the fully-tilted position until the actuator is again operated to return the base plate to its working position.

Suitably, the sheet feed apparatus also comprises a mounting platform, for example in the form of a tray or drawer, which is slidable relative to the main assembly of the copier for inserting and withdrawing the cassette to and from an operative position respectively within the main assembly. In this case the actuator and raising mechanism may be provided integrally on the mounting platform. Also, means for feeding the top sheet from the stack may be pivotally fixed to the mounting platform and linked to the actuator and raising means in such manner as to be moved to an inoperative position out of the way of the base plate when the base plate is raised out of the cassette housing. Since the top-sheet feed means is mounted integrally on the tray it may remain in operative contact with the stack of sheets even when the tray is withdrawn from the main assembly of the copier in the direction transverse to the direction of sheet feed without imparting any shear force—and hence avoiding the risk of tearing—any sheets jammed in the area of the feeding means.

In a preferred embodiment the sheet feed means comprises a first feed roll arranged to engage the top sheet of the stack, and a second feed roll downstream of said first feed roll arranged in coacting relation with retard means. The first and second feed rolls may be journaled in a one-piece housing which is fastened to a support member on the tray. This arrangement has the advantage that it enables the sheet feed means to be dismantled very easily for servicing.

Preferably the actuator handle is adapted to protrude above the level of the cassette housing when the base plate is raised so as to prevent the cassette being inadvertently re-inserted into the main assembly. Suitably the actuator may extend over the top face of the cassette housing when the base plate is in its lowest position so as to deter the insertion of further sheets without first raising the handle. To this end the actuator handle preferably extends across the full width of the cassette housing transversely to the direction of sheet feed.

Figure 2:
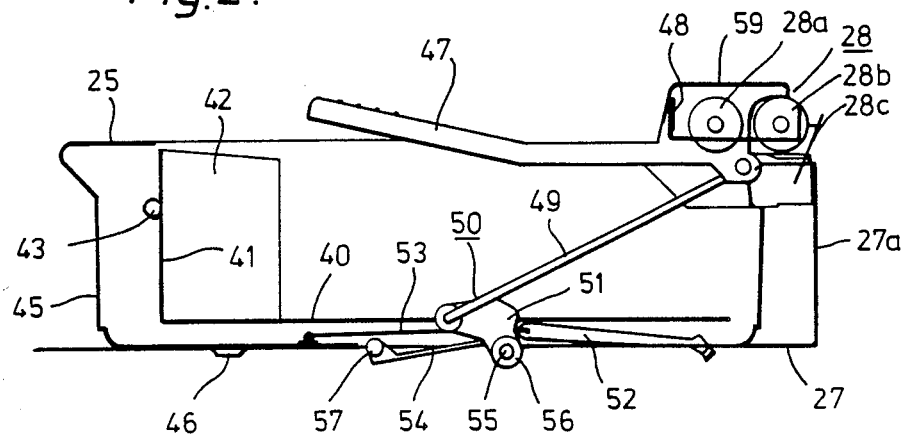
Figure 6:
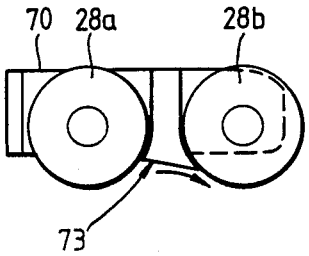
Figure 3:
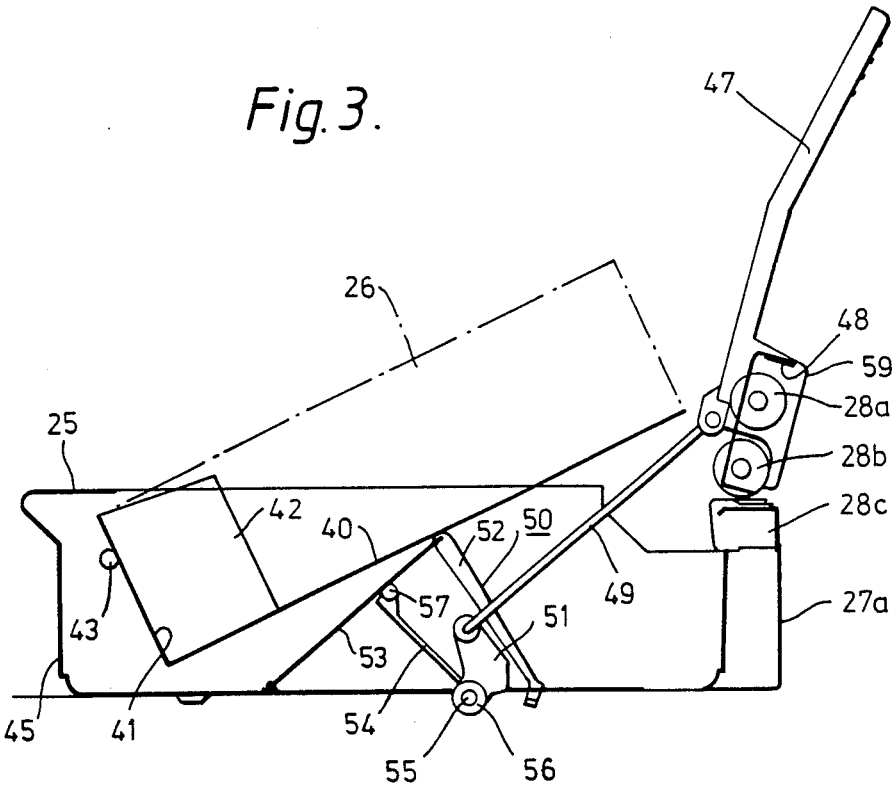
Figure 4:
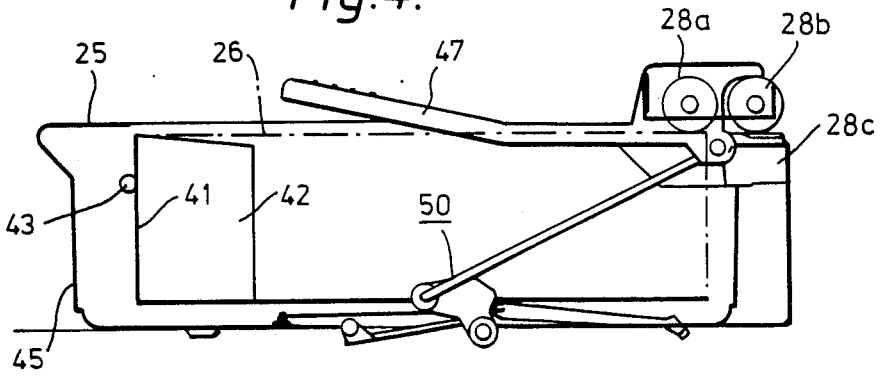
Figure 5:
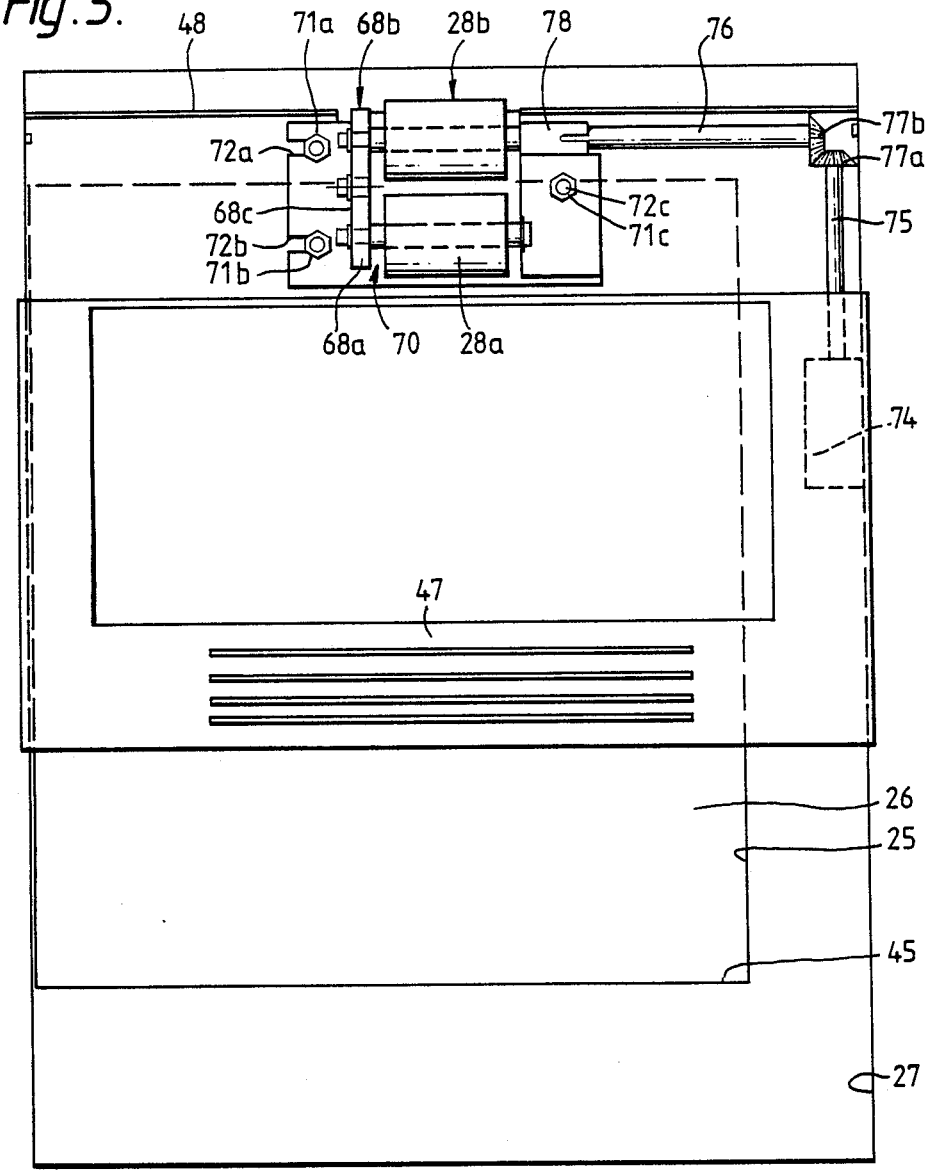

An embodiment of the invention will now be described, by way of example, with reference to the accompanying drawings in which:

FIG. 1 is a schematic cross section showing a xerographic copying machine incorporating the present invention, FIGS. 2 to 4 are cross sections of a sheet feed apparatus employing a cassette in accordance with the invention in different situations, FIG. 5 is plan view of the sheet feed apparatus in FIG. 4, FIG. 6 is a sectional view of the feed roll assembly of the apparatus.

Referring first to FIG. 1, there is shown schematically a xerographic copying machine incorporating the present invention. The machine includes an endless flexible photoreceptor belt 1 mounted for rotation (in the clockwise direction as shown in FIG. 1) about support rollers 1*a* and 1*b* to carry the photosensitive imaging surface of the belt 1 sequentially through a series of xerographic processing stations, namely a charging station 2, an imaging station 3, a development station 4, a transfer station 5, and a cleaning station 6.

The charging station 2 comprises a corotron 2*a* which deposits a uniform electrostatic charge on the photoreceptor belt 1.

An original document D to be reproduced is positioned on a platen 13 and is illuminated in known manner a narrow strip at a time by a light source comprising a tungsten halogen lamp 14. Light from the lamp is concentrated by an elliptical reflector 15 to cast a narrow strip of light on to the side of the original document D facing the platen 13. Document D thus exposed is imaged on to the photoreceptor 1 via a system of mirrors M1 to M6 and a focussing lens 18. The optical image selectively discharges the photoreceptor in image configuration, whereby an electrostatic latent image of the original document is laid down on the belt surface at imaging station 3. In order to copy the whole original document the lamp 14, the reflector 15, and mirror M1 are mounted on a full rate carriage (not shown) which travels laterally at a given speed directly below the platen and thereby scans the whole document. Because of the folded optical path the mirrors M2 and M3 are mounted on another carriage (not shown) which travels laterally at half the speed of the full rate carriage in order to maintain the optical path constant. The photoreceptor 1 is also in motion whereby the image is laid down strip by strip to reproduce the whole of the original document as an image on the photoreceptor.

By varying the speed of the scan carriages relative to the photoreceptor belt 1 it is possible to alter the size of the image along the length of the belt, i.e. in the scanning direction. In full size copying, that is to say with unity magnification, the speed of the full rate carriage and the speed of the photoreceptor belt are equal. Increasing the speed of the scan carriage makes the image shorter, i.e. reduction, and decreasing the speed of the scan carriage makes the image longer, i.e. magnification.

The image size can also be varied in the direction orthogonal to the scan direction by moving the lens 18 along its optical axis closer to the original document i.e. closer to mirrors M2 and M3, for magnification greater than unity, and away from the mirrors M2 and M3 for reduction, i.e. magnification less than unity. When the lens 18 is moved, the length of the optical path between the lens and the photoreceptor, i.e. the image distance, is also varied by moving mirrors M4 and M5 in unison to ensure that the image is properly focused on the photoreceptor 1. For this purpose mirrors M4 and M5 are suitably mounted on a further carriage (not shown).

At the development station 4, a magnetic brush developer system 20 develops the electrostatic latent image into visible form. Here, toner is dispensed from a hopper (not shown) into developer housing 23 which contains a two-component developer mixture comprising a magnetically attractable carrier and the toner, which is deposited on the charged area of belt 1 by a developer roll 24.

The developed image is transferred at transfer station 5 from the belt to a sheet of copy paper which is delivered into contact with the belt in synchronous relation to the image from a paper supply system in which a stack of paper copy sheets 26 is stored in a cassette 25 on a slidable tray 27 in accordance with the invention as described in more detail below. The top sheet of the stack in the tray is maintained in feeding engagement with a top sheet separator/feeder 28. Sheet feeder 28 feeds the top copy sheet of the stack towards the photoreceptor around a 180° path via two sets of nip roll pairs 29 and 30. The path followed by the copy sheets is denoted by a broken line in FIG. 1. At the transfer station 5 a transfer corotron 7 provides an electric field to assist in the transfer of the toner particles thereto.

The copy sheet bearing the developed image is then stripped from the belt 1 and subsequently conveyed to a fusing station 10 which comprises a heated roll fuser to which release oil may be applied in known manner. The image is fixed to the copy sheet by the heat and pressure in the nip between the two rolls 10*a* and 10*b* of the fuser. The final copy is fed by the fuser rolls into catch tray 32 via two further nip roll pairs 31*a* and 31*b*.

After transfer of the developed image from the belt some toner particles usually remain on the surface of the belt, and these are removed at the cleaning station 6 by a doctor blade 34 which scrapes residual toner from the belt. The toner particles thus removed fall into a receptacle 35 below. Also, any electrostatic charges remaining on the belt are discharged by exposure to an erase lamp 11 which provides an even distribution of light across the photoreceptor surface. The photoreceptor is then ready to be charged again by the charging corotron 2*a* as the first step in the next copy cycle.

The photoreceptor belt 1, the charge corotron 2*a*, the developer system 20, the transfer corotron 7, the cleaning station 6, and the erase lamp 11 may all be incorporated in a process unit 15 adapted to be removably mounted in the main assembly 100 of the xerographic copier.

FIG. 2 shows the cassette 25 on the tray 27 in more detail. In this Figure the cassette is empty. Tray 27 is slidably mounted relative to the main assembly 100 of the copier in the direction perpendicular to the plane of the Figure to enable the cassette to be withdrawn from its operative position within the copier for replenishing the supply of copy sheets. This form of slidable tray mounting is well-known to those skilled in the art and is not shown in the drawings. The cassette 25 comprises an open-topped housing 45 which is positioned on tray 27 by means of a pair of spaced apart protrusions 46 which locate in complementary apertures in tray 27. The protrusions 46 are spaced apart in the direction perpendicular to the plane of the Figure and hence only one such protrusion is visible in the Figure. The cassette housing 45 has an aperture in its bottom face through which a raising mechanism 50 may gain entrance as described below.

Within the cassette housing 45 is provided a base plate 40 having a rear edge registration guide 41 extending the full width of the base plate 40 and extending almost to the top of the cassette housing. A pair of edge registration guides 42 is provided one at each opposite edge of the base plate adjoining the rear guide 41. As can be seen from the Figures, the side guides 42 are substantially shorter than the side edge of the base plate along which they extend. The base plate is pivotally mounted within the cassette housing 45 about axis 43 adjacent the rear registration guide 41.

Fixed to tray 27 adjacent the end wall 27*a* thereof is a retard feeder 28 for feeding the top sheet of a stack (not shown in FIG. 2). The retard feeder 28 comprises a first feed roll 28*a* for advancing a top sheet from the stack, and a coacting roll 28*b* and retard pad 28*c* which act to prevent multi-feeds in known manner. The rolls 28*a* and 28*b* are journaled in a housing 70 (see FIG. 5) moulded as a one-piece unit from plastics material, suitably a bearing material, thus avoiding the need for separate bearings and so saving space and cost. The housing 70 is fastened to a support member 48 by bolts 71*a*, 71*b*, 71*c* extending through slots 72*a*, 72*b* and hole 72*c* in the housing. Between the feed rolls 28*a* and 28*b* the housing is extended to form an integral ramp portion 73 for guiding the sheets in the direction of the arrow (see FIG. 6) from the first roll 28*a* to the second roll 28*b* without stubbing against the second roll.

Feed roll 28*b* is driven from a motor unit 74 via orthogonally extending shaft 75, 76 and a bevelled gear arrangement 77*a*, 77*b* in conventional manner. Motor unit 74 is mounted on the internal wall of tray 27.

Drvie shaft 76 is connected to feed roll 28*b* through a coupling 78 and drive is transmitted by virtue of complementary flats provided on the mating surfaces of shaft 76 and coupling 78. Coupling 78 is provided with longitudinal slots to give it flexibility and thereby facilitate separation from the drvie shaft so that the feed roll assembly incorporating the support member 48 and integral coupling 78 can readily be removed for servicing.

Drive is transmitted to the feed roll 28*a* via a pair of gears 68*b*, 68*a* provided on the respective stub shafts of rollers 28*b* and 28*a*, and via an intermediate idler gear 68*c* intermeshing with the gear 68*a* and 68*b*.

It is noted here that the feed roll assembly is a particularly compact, easily replaceable unit and due to the integral gearing has the advantage that the gears are automatically renewed whenever the feed rolls are replaced, thus offering optimum performance.

Preferably the feed rolls 28*a* and 28*b* have associated one way clutches formed as part of the one-piece feed roll assembly permitting drive to be transmitted to the rolls in one direction, but in the reverse direction the rolls can free wheel to enable sheets jammed in the vicinity of the feed rolls to be cleared by manually withdrawing the sheets in the direction opposite to the direction of sheet feed.

A handle 47 which may be moulded from plastics material is attached to a support member 48 enclosing feed roll 28*a*. Feed roll 28*a* is mounted on support member 48 and roll 28*b* is journaled to the tray 27 via a drive shaft. Roll 28*a* is also driven by the drive shaft via roll 28*b* and gears 68*a*, 68*b*, 68*c*. A cover 59 is provided over the support member 48 to conceal the retard feeder 28 for its major part, see FIG. 5. The support member 48 is pivoted concentrically with roller 28*b* at its outer ends. Pivotally connected to the lower side of handle 47 is a rod 49 connected to a mechansm 50 for raising the base plate 40 as described in more detail below.

The handle 47 is inclined upwardly at its end remote from the retard feeder 28 so that it is more easily accessible and as can be seen most clearly from FIG. 5 is provided with a transverse bar extending across the full width of the cassette housing 45.

The raising mechanism 50 will now be described in more detail.

Pivotally connected to handle 47 below the support member 48 is a connecting rod 49 which in turn is pivotally connected to a plate member 51. The plate 51 is fixed at the end of a rod 56 which extends across the width of the cassette 25 and is journaled in the tray 27, providing the pivot axis 55 for plate 51. Rigidly fixed to the mid point of rod 56 is a bar 54 having at its extremity a roller bearing 57 which contacts the underside of arm 53. At its left-hand end arm 53 is fixedly pivoted to the tray 27 and at its opposite end is pivotally connected to a further arm 52 which in turn has its opposite end slidably mounted in the tray 27.

Thus, referring to FIG. 3, as the handle 47 is raised, connecting rod 49 rotates plate 51 and hence rod 56 in a clockwise direction about pivot axis 55 until the flat edge of plate 51 abuts the surface of tray 27. As the rod 56 rotates, so too does the integral bar 54 which causes bearing 57 to raise arm 53 which in turn raises the connected end of arm 52 while the opposite end of arm 52 begins to slide from right to left along the slot in the tray 27. The uppermost end of arm 52 bears against the underside of base plate 40 thereby causing the base plate to tilt upwards and pivot about axis 43.

As shown in FIG. 3, the handle 47 is in its fully open position having been rotated through approximately 110° so that its centre of gravity tends to urge the handle assembly to continue clockwise rotation. However, in this position plate 51 has its flat edge abutting the surface of tray 27 counteracting any further rotation. The base plate 40 is tilted through approximately 25° and the front portion of base plate 40 protrudes substantially above the level of the cassette housing 25 enabling an operator very easy access for loading a stack of sheets 26. The incline of the base plate 40 promotes registration of the sheets as the stack 26 tends to align against the rear registration guide 41 under its own weight due to gravity. The short side registration guides 42 are sufficiently substantial to locate the stack laterally but without unduly impeding access for loading.

The raising mechanism 50 described and shown herein acts as an over centre device since in the fully open position shown in FIG. 3, a line taken through the axis 55 and the axis of roller bearing 57 has rotated past the normal to the arm 53. Thus the force due to the weight of the stack of paper on the base plate 40 has a tendency to try and rotate bar 54 further in the clockwise direction, which is prevented by the flat on plate 51 abutting the surface of tray 57, and so holds the base locked firmly in the fully-tilted position until such time as the operator lowers handle 47 overcoming the forces holding it up when roller 57 passes the normal to arm 53.

It is noted here that becasue the feed roll **28*a* is fixed to the support member 48 it is pivoted around roll 28*b* when handle 47 is raised and therefore does not foul the movement of the base plate when it protrudes out of the cassette at exactly the same area where the feed roll 28*b*** would be present in its operative condition.

Thus, referring to FIG. 4, the operator having loaded a fresh stack of sheets may now lower the handle 47 causing the mechanism 50 to lower the base plate 40 while also returning the feed roll **28*a* to its operative position. The base plate 40 may be urged upwards by means of a compression spring (not shown) located between the base plate and the bottom of the cassette housing, or by means of an actuator arm (not shown) extending through the bottom of the cassette housing to maintain the top sheet of stack in feeding engagement with the feed roll 28*a*** as is known from the prior art. The handle and support member assembly may be spring biased to counter the upward force acting thereon to prevent the handle from pivoting open spontaneously, if necessary.

From FIG. 5 it is noted that the handle 47 extends the full width of the cassette housing 45 which makes it very easy to operate, but also prevents the insertion of a new stack of sheets until the handle is fully raised. Moreover, when the handle 47 is in its raised position as shown in FIGS. 3 and 4 it acts to prevent the supply tray 27 being reinserted into the main assembly 100 of the copier, the entrance for the supply tray on the main assembly being designed to accommodate the cassette 25 only when the handle 47 is lowered.

In view of the foregoing description, it will be evident to a person skilled in the art that various modifications may be made within the scope of the present invention. For example, instead of a handle the actuator for the raising mechanism may be in the form of a simple lever to one side of the cassette housing. Also, for example the arm 52 may be dispensed with as this plays no crucial role in the lifting mechanism, its principal purpose being to prevent the liffing mechanism 50 from fouling against the aperture in the underside of the cassette housing 45 when the cassette 25 is removed from the tray 27. Furthermore the arm 53 may also be dispensed with and instead the roller bearing 57 on bar 54 may be arranged to bear directly against the underside of base plate 40.

What is claimed is:

1. Sheet feed apparatus for a copying machine comprising a cassette for holding a stack of sheets to be fed, wherein the cassette comprises an open-topped housing containing a base plate for supporting the stack of sheets, characterised by a manually operable actuator coupled to means for raising at least part of the base plate out of the cassette housing to facilitate loading sheets in the cassette, and wherein the actuator is movable between a first position in which the at least part of the base plate is in its operative position for sheet feeding, and a second position in which the at least part of the base plate is in its fully raised position for sheet loading.

2. Sheet feed apparatus as claimed in claim 1, comprising a tray including a mounting platform for the cassette, and wherein said tray is slidable relative to the main assembly of the copier for inserting and withdrawing the cassette to and from an operative position respectively, wherein the actuator and means for raising at least a part of the base plate out of the cassette housing is provided integrally with the mounting platform.

3. Sheet feed apparatus as claimed in claim 2, comprising means for feeding the top sheet from the stack, wherein the top-sheet feed means is pivotally fixed to the mounting platform and is linked to the actuator and said means for raising at least part of the base plate out of the cassette housing so as to be moved to an inoperative position out of the way of the base plate when the base plate is raised out of the cassette housing.

4. Sheet feed apparatus as claimed in claim 3, wherein the sheet feed means comprises a retard means a first feed roll arranged to engage the top sheet of the stack, and a second feed roll downstream of said first feed roll arranged in coacting relation with said retard means.

5. A sheet feed apparatus as claimed in claim 4, wherein the sheet feed means is pivotally mounted coaxially with said second feed roll.

6. A sheet feed apparatus as claimed in claim 5, wherein said first and second feed rolls are includes in a one-piece housing which is fastened to a support member on the tray.

7. A sheet feed apparatus as claimed in claim 6, wherein the housing comprises an integral ramped portion for guiding sheets between the first and second feed rolls.

8. Sheet feed apparatus as claimed in claim 7, wherein one of the feed rolls is driven directly by a shaft and the other feed roll is driven indirectly by the shaft via a system of gears.

9. A sheet feed apparatus as claimed in claim 8, wherein the drive shaft is provided with a separable coupling adjacent the one-piece housing.

10. Sheet feed apparatus as claimed in claim 9, wherein the base plate has an upstanding registration guide at its rear edge relative to the direction of sheet feed, and an upstanding registration guide at each opposite side edge adjacent the rear edge, wherein the base plate is pivotally mounted within the cassette housing adjacent the rear registration guide.

11. Sheet feed apparatus as claimed in claim 10, wherein the side registration guides are substantially shorter than the side edges of the base plate along which they extend.

12. Sheet feed apparatus as claimed in claim 11, wherein the means for raising at least part of the base plate out of the cassette housing is adapted automatically to hold the base plate locked in the fully raised position when the actuator is moved to the second position, and automatically release the base plate when the actuator is moved to the first position.

13. Sheet feed apparatus as claimed in claim 12, wherein the actuator is adapted to protrude above the level of the cassette housing in the second position.

14. Sheet feed apparatus as claimed in claim 13, wherein the actuator is in the form of a handle.

15. Sheet feed apparatus as claimed in claim 14, wherein the actuator handle extends over the top face of the cassette housing when the actuator handle is in the first position.

16. Sheet feed apparatus as claimed in claim 15, wherein in the first position the actuator handle extends the full width of the cassette housing transversely to the direction of sheet feed.

* * * * *